US006584895B1

(12) United States Patent
Strauch et al.

(10) Patent No.: US 6,584,895 B1
(45) Date of Patent: Jul. 1, 2003

(54) APPARATUS FOR PRINTING ON INDIVIDUAL ARTICLES

(75) Inventors: Karl Strauch, Kirchlengern (DE); Wilfried Kammann, Bünde (DE)

(73) Assignee: Balsfulland Maschinenfabrik GmbH, Schloss Holte-Stukenbrock (DE)

( * ) Notice: Subject to any disclaimer, the term of this patent is extended or adjusted under 35 U.S.C. 154(b) by 60 days.

(21) Appl. No.: 09/711,283

(22) Filed: Nov. 13, 2000

(30) Foreign Application Priority Data

Jun. 14, 2000 (DE) ..... 100 29 181

(51) Int. Cl.[7] ..... B41F 17/08
(52) U.S. Cl. ..... 101/38.1; 101/40; 101/115
(58) Field of Search ..... 101/35, 38.1, 39, 101/40, 40.1, 115, 116, 123

(56) References Cited

U.S. PATENT DOCUMENTS

| | | | | | |
|---|---|---|---|---|---|
| 2,077,647 | A | | 4/1937 | Stokes et al. | 113/27 |
| 2,207,351 | A | | 7/1940 | McLaughlin et al. | 101/124 |
| 2,261,255 | A | | 11/1941 | Jackson | 101/124 |
| 3,209,688 | A | | 10/1965 | Eldred et al. | 101/407 |
| 3,543,680 | A | | 12/1970 | Killen et al. | 101/40 |
| 3,842,733 | A | | 10/1974 | Dubuit | 101/38 A |
| 3,960,073 | A | * | 6/1976 | Rush | 101/40 |
| 4,092,949 | A | * | 6/1978 | Balordi | 101/40 |
| 4,263,846 | A | | 4/1981 | Eldred et al. | 101/40 |
| 4,750,419 | A | | 6/1988 | Meredith | 101/40 |
| 4,771,879 | A | * | 9/1988 | Shriver | 101/40 |
| 4,798,135 | A | | 1/1989 | Meredith | 101/40 |
| 5,335,594 | A | * | 8/1994 | Karlyn et al. | 101/115 |
| 5,372,064 | A | * | 12/1994 | Dubuit et al. | 101/124 |
| 5,456,169 | A | * | 10/1995 | Rohwetter et al. | 101/126 |
| 5,471,924 | A | | 12/1995 | Helling | 101/38.1 |
| 5,711,216 | A | | 1/1998 | Tiemann et al. | 101/40.1 |
| 6,164,199 | A | * | 12/2000 | Dubuit et al. | 101/124 |

FOREIGN PATENT DOCUMENTS

| | | |
|---|---|---|
| FR | Ad.91.131 | 8/1968 |

* cited by examiner

*Primary Examiner*—Ren Yan
(74) *Attorney, Agent, or Firm*—Drinker Biddle & Reath LLP

(57) ABSTRACT

In an apparatus for printing on dimensionally stable individual articles such as glass or plastic bottles, using screen printing, the articles each carried by a respective holder are transported along a transport path by a continuously circulating transport device. At least one treatment station and at least two transfer stations are associated with the transport path, one transfer station acting as a feed station and the other as a removal station for the articles. During a printing operation on an article the article is rotated about its longitudinal axis in a first direction which is governed by the printing procedure and the transport direction, and then after conclusion of the printing operation the article is rotated back into its initial position by rotation about its longitudinal axis in the opposite direction, so that the position of the article in angular terms about its longitudinal axis can be accurately defined and controlled.

19 Claims, 8 Drawing Sheets

APPARATUS FOR PRINTING ON INDIVIDUAL ARTICLES

FIELD OF THE INVENTION

The invention concerns an apparatus for printing on individual articles, more particularly individual articles which are dimensionally stable, for example for decorating the articles, such as for decorating bottles of glass or plastic material, for instance using a screen printing process.

BACKGROUND OF THE INVENTION

The use of modern printing inks which are at least substantially free from environmentally harmful constituents and which are hardenable for example by means of UV-radiation, in which respect attention may be directed for example to U.S. Pat. No. 5,985,376, is giving rise to a demand for printing machines and in particular screen printing machines which offer a very high level of throughput capacity.

As in future light glass bottles and in particular light glass bottles for drinks will be used to an ever increasing extent, it is not always possible for the bottles to be provided with register marks in the form of recesses, more particularly in the bottom of the bottle or at the edge of the bottom of the bottle, for the engagement therein of some form of register member such as register pins so that the article can be oriented and aligned in a specific fashion in the peripheral direction thereof, for example within a holder for carrying the article in a printing machine. Such specific orientation is required in particular when, as is the usual practice in particular when employing multi-color printing, a plurality of partial print images are successively applied to the article by the printing procedure, so that after the printing procedure is concluded the plurality of partial print images supplement each other to form the overall print image.

SUMMARY OF THE INVENTION

An object of the present invention is to provide an apparatus for printing on individual articles such as bottles, in which the article can be satisfactorily brought into a defined angular position in a holder for carrying the article and remains in that angular position throughout the entire operational passage through the apparatus, whereby there is then no longer any need for a renewed procedure for bringing the article into the correct registration relationship.

Another object of the present invention is to provide an apparatus for applying decoration to dimensionally stable individual articles by a printing procedure with which the movement of a holder for an article can be executed while passing through the machine in an accurately controllable and thus also accurately definable manner to afford a high-quality printing result.

A further object of the present invention is to provide an apparatus for printing on dimensionally stable individual articles which is of such a design configuration as to provide a high degree of accuracy in its operating movements and therewith a high level of quality in terms of the resulting print image in particular when implementing a multi-color printing procedure.

In accordance with the principles of the present invention the foregoing and other objects are attained by an apparatus for printing on dimensionally stable individual articles, for example for applying decoration thereto, comprising a continuously circulating transport means for transporting the articles along a transport path, each article being carried by a respective holder. The transport path has in operative association therewith at least one treatment station and at least first and second transfer stations. One of the transfer stations is in the form of a feed station in which the articles to be printed upon are fitted on to or into holders transported by the transport means. The other of the transfer stations is in the form of a removal station in which the printed articles are removed from the holders. During the printing operation the article is rotated about its longitudinal axis by suitable means in a first direction determined by the printing procedure and the transport direction, and after termination of the printing procedure the article is rotated back into its initial position by a rotation thereof about its longitudinal axis in a second direction opposite to the first direction.

As will be seen in greater detail from a description hereinafter of a preferred embodiment of the apparatus according to the invention, an article to be printed upon executes rotary movements in reciprocating manner about its longitudinal axis, which rotary movements may be 360° or possibly even somewhat more. The arrangement of the apparatus is such that the rotary movement in a first direction takes place during a printing procedure in which the article is for example being rolled against a screen printing stencil. After termination of the printing procedure the article is rotated back into its initial position again, by rotation about its longitudinal axis in a second direction opposite to the first direction. In dependence on the arrangement of the individual treatment stations along the transport path, during that second rotary movement, the article can also pass through a drying station, for example and preferably a UV-station, in which case the printing ink which has just been applied to the article for example for decoration purposes thereon is at least dried and set to such an extent that a further partial print image can be applied to the article, without that adversely affecting the quality of the first partial print image already thereon.

In accordance with a preferred feature of the invention the article holders or receiving means provided by the holders for receiving the articles are rotated by way of a pivotably mounted toothed element which is movable with the respective holder and which is in engagement with a gear fixed to the above-mentioned receiving means, wherein that toothed element is provided with a cam roller engaging into a first cam which is mounted to the machine frame structure and the configuration of which is so selected that during the movement of the holder along the transport path along which the cam also extends, the article is caused to perform the above-indicated rotary movements about its longitudinal axis. Cams of that kind can be implemented with an extremely high degree of precision, while in the case of an endless cam in which the cam roller always remains in operative engagement with the cam, this also ensures that the holder and therewith the article secured therein are maintained in a position which is properly definable and controllable at any location on the transport path.

On the other hand the use of a cam with cam rollers makes it possible not to rotate the article in given portions along the transport path in the apparatus. That can be achieved without entailing particular expenditure by virtue of the cam extending substantially parallel to the transport path in the respective sections in which the article is not to be rotated. That will be desirable for example in the regions of the transport path, in which the articles to be printed upon are introduced into the apparatus or in which the articles with printing thereon are to be removed from the apparatus. In both cases such a transfer procedure can be carried out more easily if the holders are not rotating.

The reciprocating rotary movement of the articles with their holders is advantageous in particular when dealing with articles which have projection portions or the like protruding laterally beyond the contour of their body portion, for example handles or gripping configurations, as such projecting portions, upon a rotary movement which takes place only in one direction, require space which is not available in the majority of cases. At any event there is the possibility that the articles are properly oriented and aligned during the feed transport thereof to the apparatus, for example when being transported on a conveyor belt or in a transfer procedure, in dependence on the position of the above-mentioned handle or, if the article does not have such a handle, for example also in dependence on the position of a seam on the outside surface of the article, so that, upon being fitted into their respective holders, the articles assume in relation thereto a defined angular position in the peripheral direction, which is then maintained throughout the movement of the articles through the treatment stations.

In a further aspect of the invention the foregoing and other objects are attained by an apparatus for printing on dimensionally stable individual articles including a continuously circulating transport means for transporting the articles each carried by a respective holder along a transport path, the transport means comprising an odd number of holders for the articles, and further including at least first and second printing stations such as screen printing stations and a drying station downstream of the two respective printing stations in the transport direction. In each passage of the articles through the transport path, printing is effected only in one of the at least first and second printing stations disposed upstream of the common printing station, and the printing stations in which an article is printed upon during a circulatory movement are at a spacing from each other which is an even multiple of the spacing of two adjacent receiving means for receiving articles in the holders, in the transport direction. The spacing between first and second printing stations which in the transport direction are arranged upstream of a common drying station is an odd multiple of the spacing of two adjacent receiving means.

As will be further seen from the description hereinafter of a preferred embodiment, the arrangement as set forth in the preceding paragraph in respect of the printing stations and the drying stations affords the advantage of a lower level of capital investment costs as there is no need for a particular drying station to be arranged downstream of each printing station which for example may typically be a screen printing station. In addition, in terms of its utility, this apparatus affords an increased degree of flexibility as it is possible for example to provide an article with multi-color printing thereon, with the number of colors or inks used in the printing operation corresponding to the number of printing stations with which the apparatus is provided. On the other hand it is possible to use the apparatus for printing on articles with a respective print image comprising a plurality of partial print images, the number of which corresponds for example to half the number of printing stations in the machine. In this respect, in comparison with the first use, it would be possible to achieve double the output, in relation to the number of articles printed per unit of time.

Further objects, features and advantages of the invention will be apparent from the description hereinafter of a preferred embodiment of the invention.

DESCRIPTION OF THE PREFERRED EMBODIMENT

Figure 1:
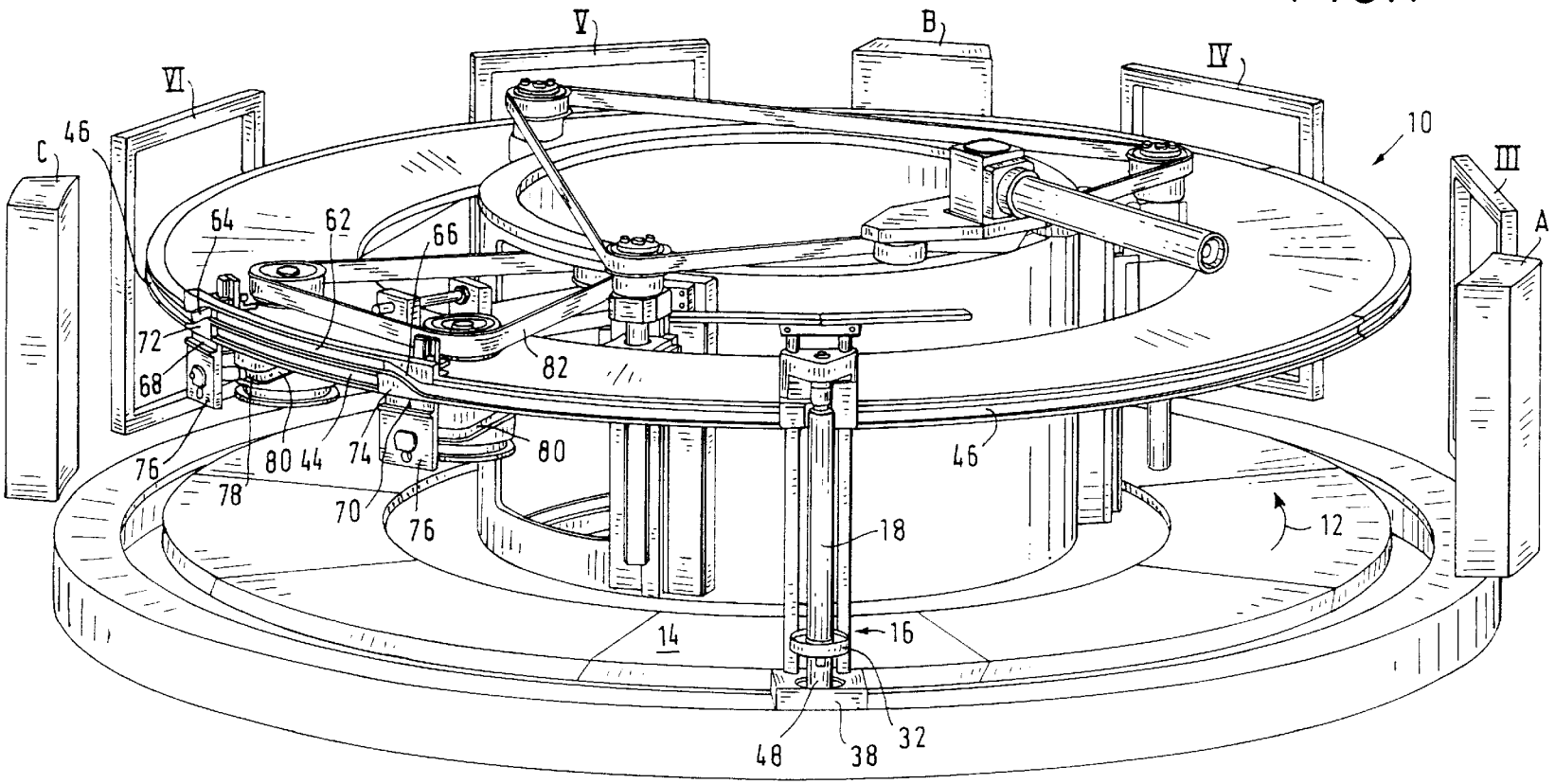
FIG. 1 is a perspective view of a printing machine, treatment and processing stations which are towards the person looking at the drawing having been omitted for the sake of enhanced clarity of the view on to the structure of the apparatus.

Referring firstly to FIG. 1, an apparatus according to the invention in the form of a printing machine for printing on dimensionally stable individual articles, for example bottles of glass or plastic material, for example for the purposes of applying decoration thereto, as indicated generally by reference numeral 10, has an annular disk or plate 14 which in operation of the apparatus circulates continuously in the direction of an arrow 12 and on which a plurality of holders 16 for the respective articles 18 to be decorated are mounted distributed at regular spacings around the periphery of the disk 14. Arranged around the periphery of the disk 14 on the outside thereof are units and apparatuses which are necessary for handling and treatment of the articles, for example transfer stations having transfer devices as indicated at 22 and 30 respectively, printing stations as indicated at I through VI in the form of screen printing stations, and drying stations A through C. FIG. 1 does not show transfer stations and the screen printing stations I and II for the sake of enhanced clarity to afford a better view on to the structure within the apparatus.

Figure 2A:
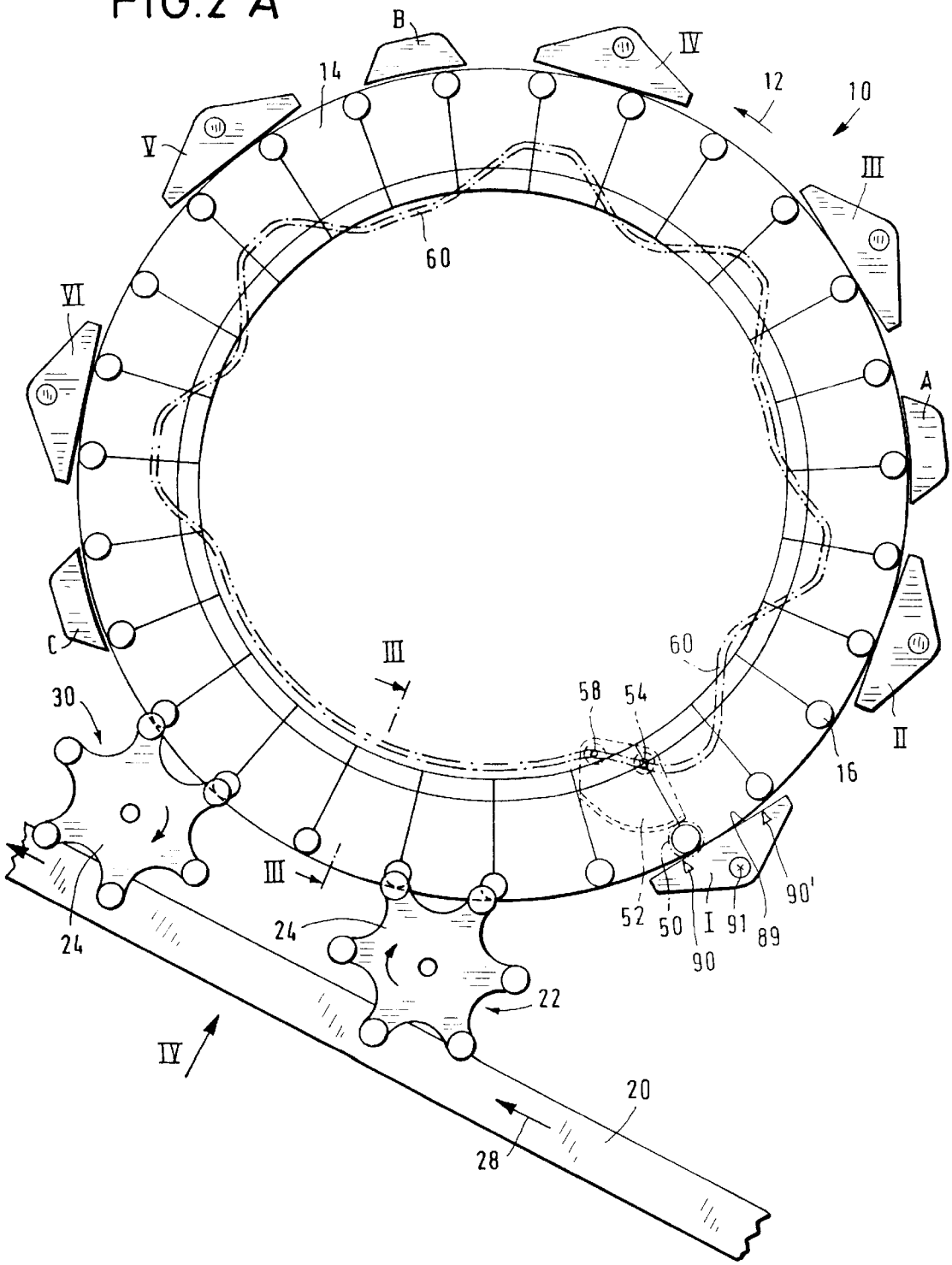
FIG. 2A is a plan view of the transport means of the FIG. 1 printing machine for articles to be processed, in a first position of the control arrangement for the holders of the apparatus.

FIG. 2A in particular shows that, in the direction 12 of circulating movement which corresponds to the direction of transportation movement of the articles 18 in the printing machine, arranged downstream of each two printing stations I and II, III and IV, V and VI respectively is a respective printing station as indicated at A, B and C respectively. It will be seen therefrom that, if the printing ink has to be dried after each printing operation, the article is respectively printed upon only in one of the two screen printing stations which is disposed upstream of a drying station in the transport direction 12. In that case, when an article passes through the apparatus, it is printed upon only in three respective ones of the screen printing stations, with the consequence that the production on an article of a printed image which involves six colors requires the article to be passed through the apparatus in two passes. Accordingly, the printing stations can be subdivided into two groups, wherein the printing stations in the first group apply a respective print image to an article in the first passage thereof through the apparatus. In the case of the embodiment illustrated in the drawings, that group comprises the printing stations I, IV and V. The printing stations II, III and VI in which, on the above-indicated assumption, a respective partial print image is only applied in the second passage of an article through the apparatus, belong to the second group. It will be seen therefrom that, in the operation of applying printing to the articles during the first passage thereof through the apparatus, the respective article passes through the printing stations II, III and VI without a printing operation taking place therein. A corresponding consideration applies in regard to the printing stations constituting the first group, during the second passage of the articles through the apparatus.

Figure 2B:
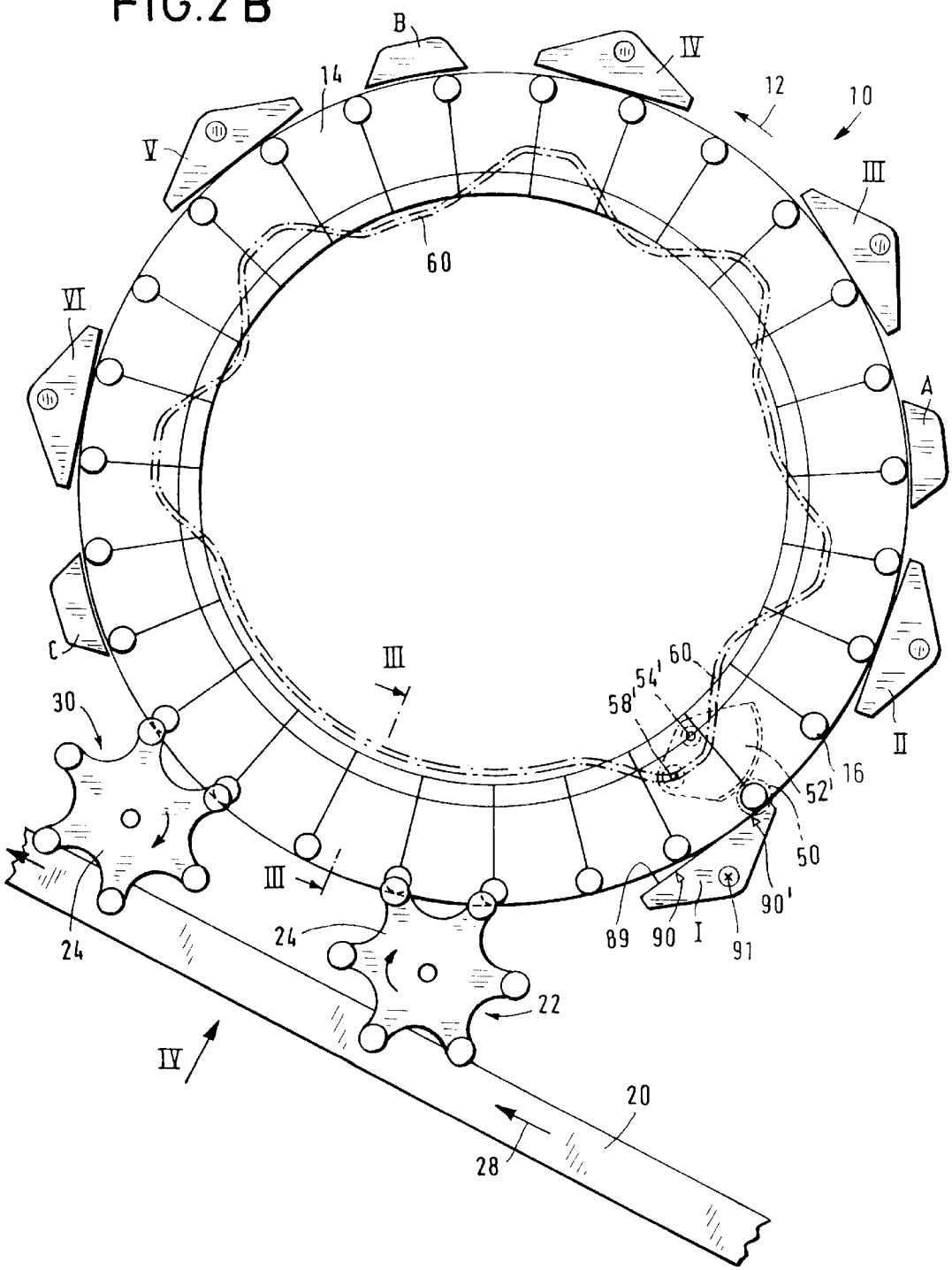
FIG. 2B is a view corresponding to FIG. 2A but showing the control arrangement for the article holders in another position.

It will further be seen from FIGS. 2A and 2B that the peripheral spacing between the printing stations I and IV in which the first two successive printing operations are implemented in the course of the first passage of an article through the apparatus corresponds to the spacing of ten holders as indicated at 16 for carrying respective articles. The peripheral spacing between the printing station IV and the printing station V in which the third printing operation takes place during the first passage of an article through the apparatus corresponds to the spacing of four holders 16 in arcuate terms. The spacing between the printing station V and the printing station II in which the fourth printing operation takes place when the articles 16 are involved in two passages through the apparatus corresponds to the spacing of sixteen holders 16. The spacing of the printing station III in which the fifth printing operation is carried out from the printing station II corresponds to the spacing of four holders. Finally the spacing between the printing station III and the printing station VI in which the last printing operation is carried out corresponds to the spacing of ten holders.

The fact that the apparatus has an odd number of receiving means for receiving the respective articles, more specifically for example twenty seven in the present embodiment, means that the printing stations of the two above-mentioned groups are arranged in displaced relationship with each other in the peripheral direction, that is to say in the transport direction 12, in such a way that the spacing between the printing stations of the one group and the printing stations of the other group is in each case an odd multiple of the spacing of two adjacent receiving means for the articles. In this respect particular attention is directed to FIG. 2A and 2B which clearly show the relationships involved.

The articles to be printed upon, as indicated diagrammatically for example at 18 in FIG. 1, are fed to the printing machine 10 by way of a conveyor belt indicated at 20 in FIGS. 2A and 2B, on which the articles are arranged in an upright standing position. Transfer of the articles 18 to be printed upon, from the conveyor belt 20 into or on to one of the holders 16 of the printing machine, is effected in the feed station of the apparatus, using a first transfer device as indicated at 22 in FIGS. 2A and 2B comprising a plate 24 which rotates continuously about a vertical axis in the direction of an arrow indicated at 23 in FIGS. 6 and 7. The plate 24 is provided with three grippers shown at 26 in FIGS. 6 and 7 which are disposed at its underside near the periphery thereof at uniform spacings over its periphery. Each gripper 26 engages the respective article 18 to be printed upon, which is the first article in the direction of transportation movement 28 of the conveyor belt 20, and in the course of the continuous rotary movement of the plate 24, guides that article into the region of the respective holder 16 which is in the feed station of the printing machine 10.

Provided at a short distance from the first transfer device 22 downstream thereof in the direction of conveying movement 28 of the conveyor belt 20 which extends substantially tangentially with respect to the annular disk 14 representing the transport device of the printing machine 10 is a second transfer device 30 which is of the same configuration as the first transfer device 22 and which in the direction of transportation movement 12 of the transport device 14 is arranged upstream thereof and serves to remove the finished printed bottles from the respective holder 16 as it passes through the removal station. The removed bottles are also deposited on the conveyor belt 20 which thus also serves to carry the printed bottles away.

Figure 6:
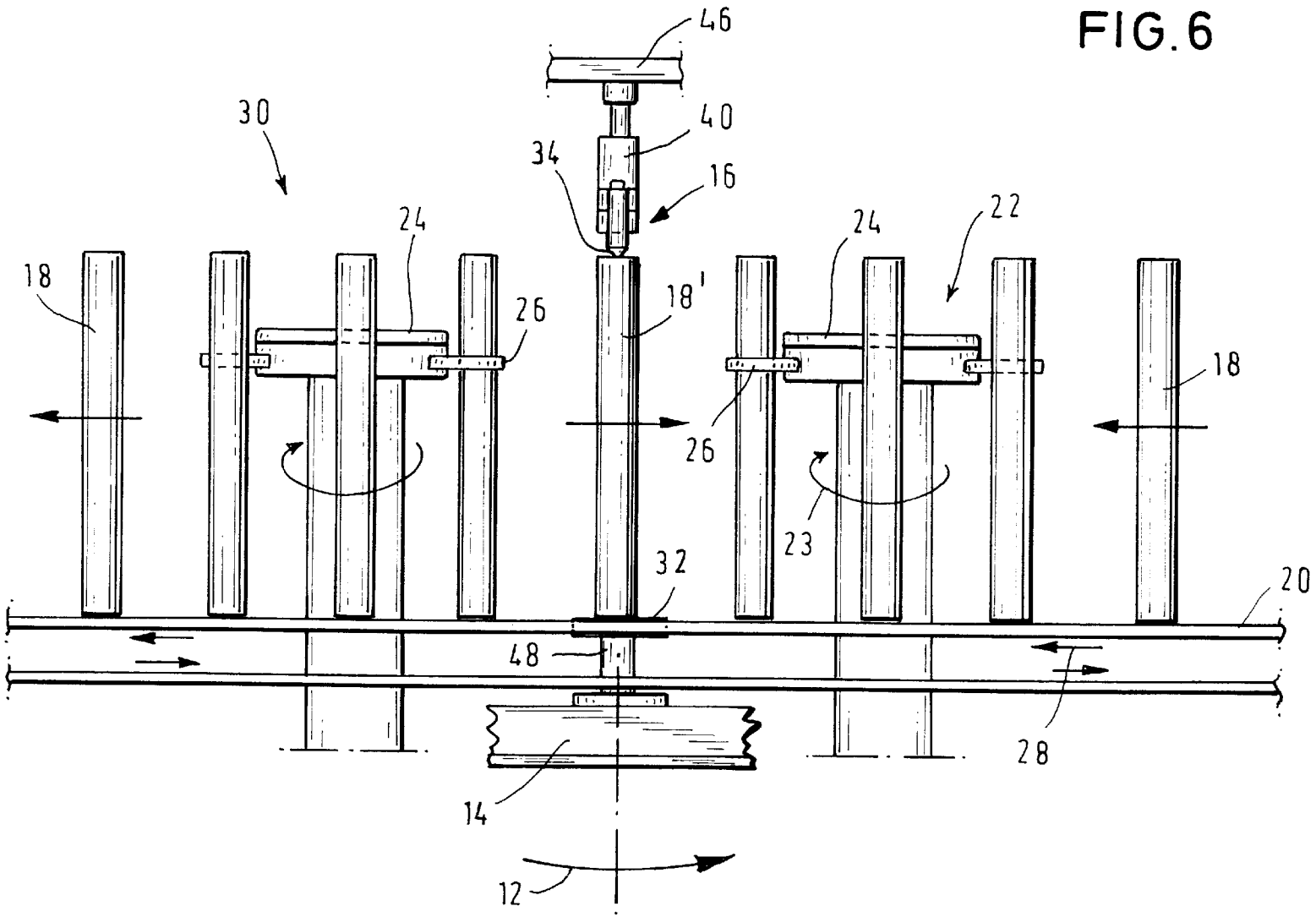
FIG. 6 is a view substantially viewing in the direction of the arrow VI in FIG. 2A, with component parts of the assembly being omitted in FIG. 6.
Figure 7:
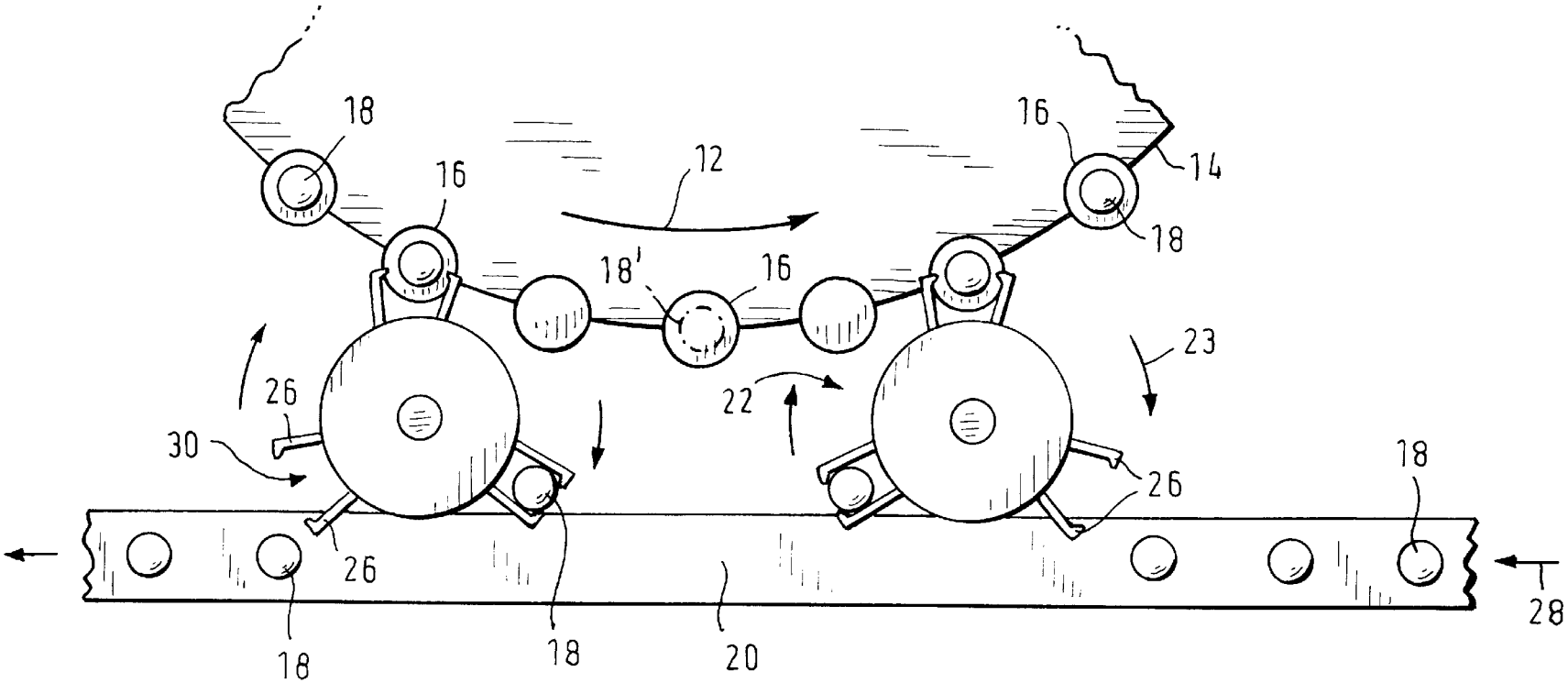
FIG. 7 is a plan view approximately corresponding to FIG. 6, with further component parts being omitted.

When the articles 18 each pass through the machine twice, it is only each second article which arrives at the removal station that is already provided with a complete print image thereon so that consequently it is also only each second article, namely the article which is completely printed for example with all colors thereon, that is removed from the respective holder 16 by means of the transfer device 30. The consequence of this is that only each second holder 16 which passes through the feed station 22 is empty and accordingly an article to be printed upon can only be introduced into each second holder 16, by the transfer device 22. Accordingly, in the embodiment illustrated in the drawings, the two transfer devices 22, 30 are each only provided with three grippers 26 which are disposed at equal spacings of 120° in arcuate terms about the periphery of the respective transfer device. It will be apparent that, when an article 18', as shown in FIGS. 6 and 7, after the termination of the first passage thereof through the apparatus, passes the two transfer devices 22 and 30 for implementation of the second passage of the article through the apparatus, it passes through that peripheral region of the respective transfer device 22 or 30 at which there is no gripper present or at which such a gripper if present is not actuated, at the removal station and the or feed station respectively.

If the articles are only printed upon in a respective one of the two above-indicated groups of printing stations and are thus removed from the machine after one passage therethrough, the transfer devices 22, 30 will be provided with six grippers which are then at an angular spacing from each other of 60° in each case, as in that situation each article arriving at the removal station formed by the transfer device 30 is removed thereby and similarly in the feed station, an article must be introduced into each of the holders 16 passing same, by means of the transfer devices 22.

Instead of the plates 24 illustrated in for example FIGS. 2A and 2B, the transfer devices 22 and 30 may also be provided with other suitable means for performing the similar function, for example other circulating devices such as for example chain conveyors, the movement and path of activity of which can be suitably adapted to the circular path of movement of the transport device 14 of the machine 10.

Figure 3:
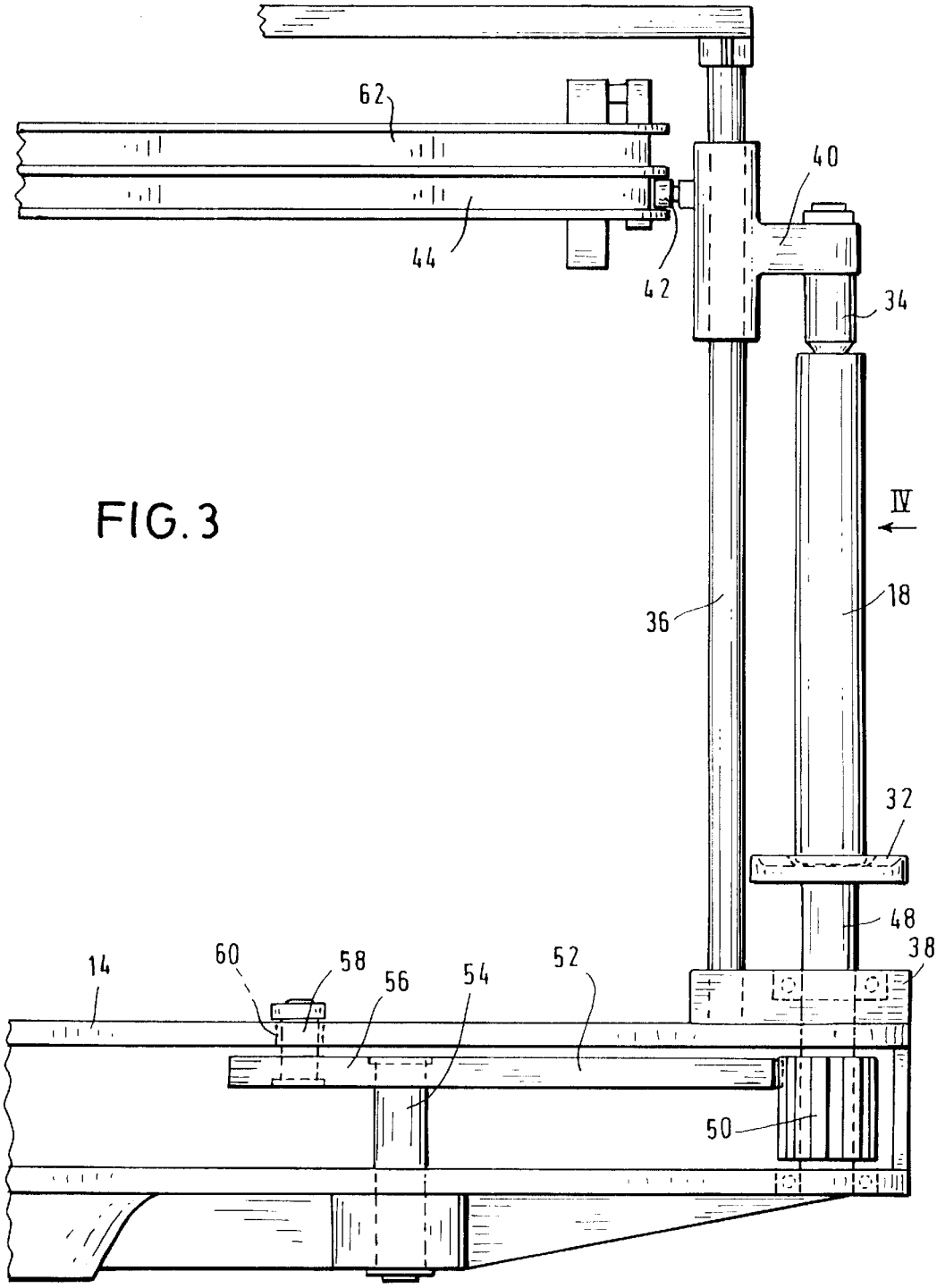
FIG. 3 shows a view of a holder with an article disposed therein substantially viewing in the direction of the arrows III—III in FIG. 2.
Figure 4:
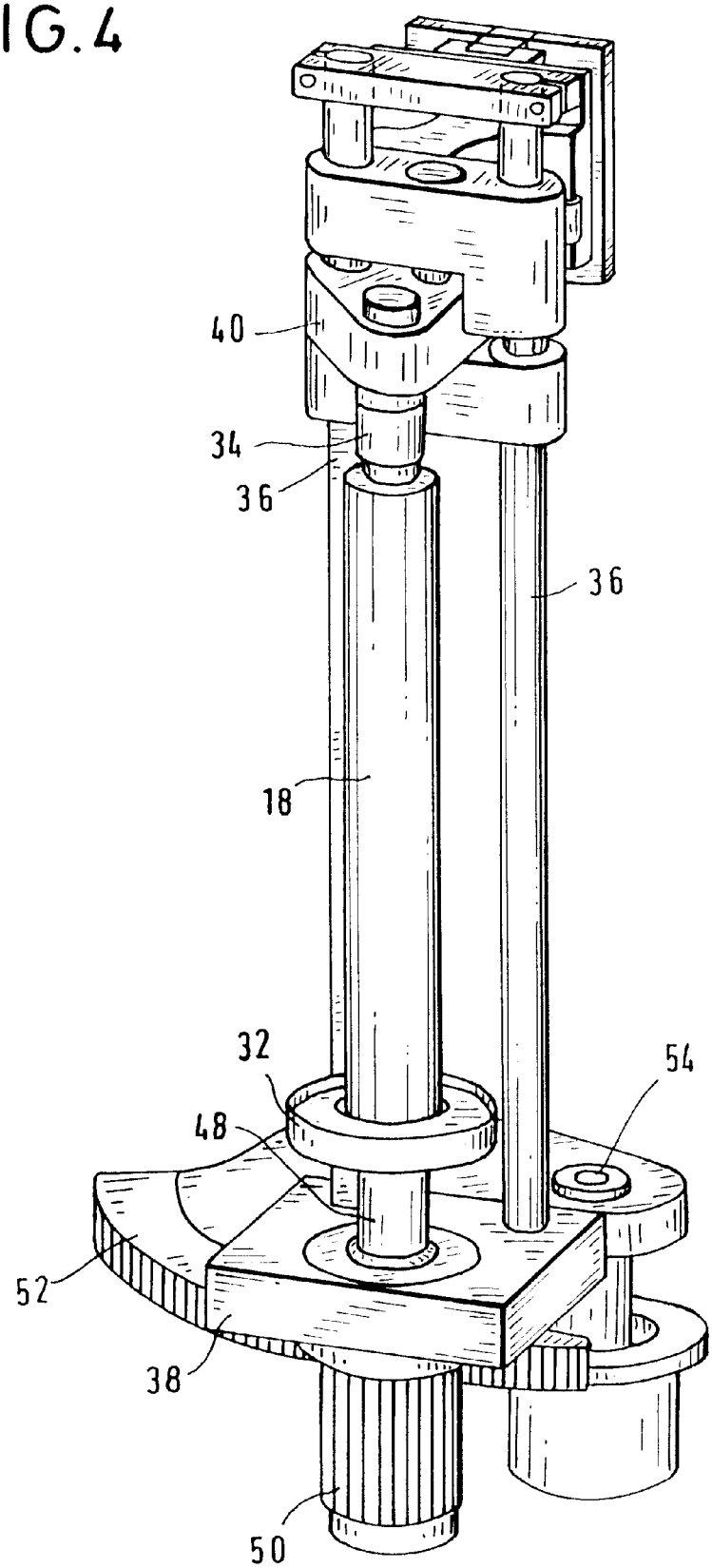
FIG. 4 is a view of the holder substantially viewing in the direction of the arrow IV in FIG. 3.

As already mentioned above, the printing machine 10 illustrated in this embodiment has twenty seven holders 16, being therefore an odd number thereof, the configuration of which can be seen more particularly in FIGS. 3 and 4. Referring accordingly thereto, each holder 16 has a lower holder portion 32 in the form of a receiving means for receiving a respective article, and an upper holder portion 34 which in the embodiment illustrated herein is of a mandrel or bar configuration and which in its operative position engages for example into an opening at the neck of an article 16 of a bottle shape. The upper holder portion 34 can be designed to taper conically inwardly towards its free end in the usual fashion. It is guided on two vertical bars or rods 36 supported by a base 38 mounted on the annular disk 14. The upper holder portion 34 is carried by a slide 40 on which is mounted a cam roller which is indicated at 42 in FIG. 3 and which is rotatable about a horizontal axis. With the holder 16 in the position shown in FIG. 3, the cam roller 42 is in engagement with a control cam portion 44 which is part of a circular first cam 46 suitably mounted to the machine frame structure.

The lower holder portion 32 which is of a generally plate-like configuration is supported by a vertically extending coaxial shaft 48, in which respect reference numeral 50 denotes a gear secured to the end of the shaft 48, which is remote from the lower holder portion 32. Reference numeral 52 denotes a toothed segment which is in meshing engagement with the gear 50 and which is mounted on the disk 14 rotatably about a vertical axis as indicated at 54.

Reference numeral 56 in FIG. 3 denotes a projection portion on the toothed segment 52, on which is mounted a cam roller 58 which engages into a second cam 60. The second cam 60 is mounted stationarily to the machine frame structure beneath the annular disk 14 which, as mentioned above, represents the transport device of the printing machine 10. The configuration of the cam 60 which extends along the entire endless transport path defined by the annular disk 14 is so selected that a pivotal movement of the cam roller 58 and therewith the toothed segment 52 about the axis 54, which occurs during the transport movement of the holder 16 through the printing machine 10, causes a rotary movement of the gear 50 and therewith the lower holder portion 32 constituting the receiving means for receiving a respective article 18, in such a way that the article 18 supported by the lower and upper holder portions 32, 34 is rotated about its longitudinal axis in dependence on the angular positions to be assumed in given treatment stations of the printing machine, in terms of the periphery of the article 18. In that situation, the upper holder portion 34 which is not driven is entrained by the article 18 which is caused to rotate by virtue of the rotary movement of the lower holder portion 32.

Figure 5:
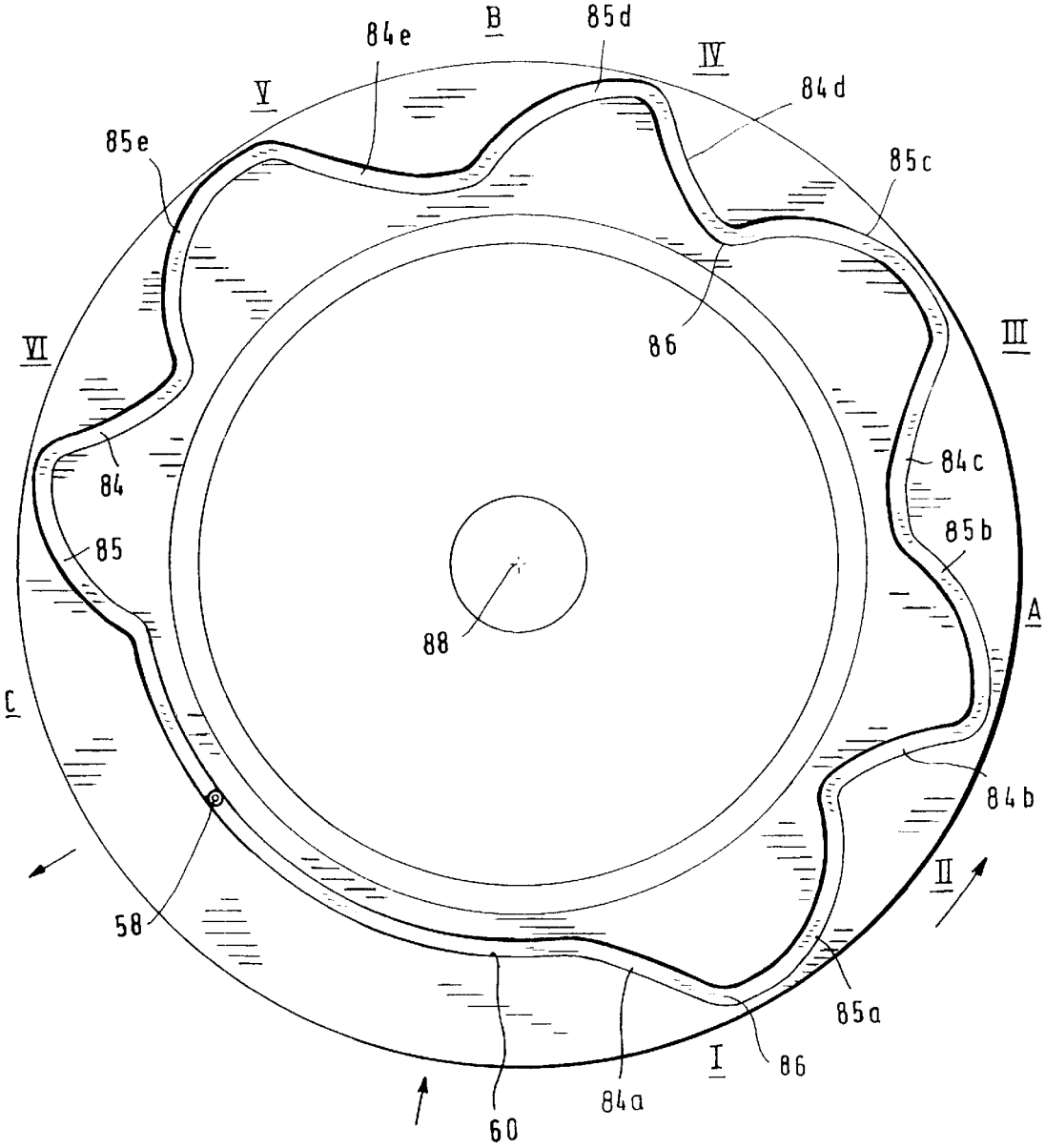
FIG. 5 is a plan view of a cam producing the rotary movement of the articles.

Reference will now be made more particularly to FIG. 5 showing the configuration of the cam 60 along the transport path for the articles, thereby to produce a reciprocating pivotal movement of the toothed segment 52.

As long as a respective holder 16 is disposed in a region of the first or upper cam 46 in which the cam roller 42 operatively associated with the holder 16 adopts the position illustrated in FIG. 3 and the upper holder portion 34 is pressed against the article 18 supported in the lower holder portion or receiving means 32, the article 18 is fixed in the holder 16 in such a way that it cannot move with respect to the two holder portions 32 and 34. For that purpose, it is desirable for the upper holder portion 34 to be mounted to its slide 40 rotatably about the longitudinal axis of the article 18 in the usual manner. For the purposes of removal of a printed article 18 from the holder 16 and for the purposes of introducing an article 18 which is to be printed upon, into the holder 16, the holder 16 must be suitably opened. The upper holder portion 34 is displaceable vertically for that purpose. This is implemented in the region of the removal station at the transfer device 30 and the transfer station at the transfer device 22 by virtue of the cam 46 being of a suitable configuration. For that purpose in the region of the removal station and the feed station, the cam 46 is provided with a stationary portion indicated at 62 in FIG. 1 and also in FIG. 3, which is displaced upwardly with respect to the main portion of the cam 46 by a distance which is sufficient for the cam roller 42 and therewith the slide 40 to be lifted in the region of a first transitional portion indicated at 64 in FIG. 1 between the main portion and the upper cam portion 62, to such an extent that the upper holder portion 34 comes out of engagement with the respective article 18 carried in the holder 16. In that respect, the arrangement is such that, at the latest at the moment of release of the article 18 by the upwardly displaced second holder portion 34, the article is engaged by one of the grippers 26 of the second transfer device 30 and is held by that gripper which immediately thereafter also implements an upward movement in order to lift the article 18 out of the lower holder or receiving means 32 and to move it in the cause of the further rotary movement of the plate 24 into a position above the belt 20 and then by means of a downward movement to place it on the belt 20 on which the article 18 is then further transported. Therefore, the article maintains its standing upright position unchanged during the feed transportation movement by means of the belt 20, during the passage of the article through the treatment stations of the printing machine 10 and in the removal transportation movement on the belt 20 after the printing operation, and also in the transfer stations.

During the further transportation movement of the holder which is now empty, along the region in which the upper cam portion 62 is disposed, the holder remains in the open condition so that, in the feed station which follows shortly thereupon, a fresh article 18 which is to be printed upon is moved by a gripper 26 of the first transfer device 22 into the region of the open holder 16 and is introduced into the lower holder portion 32 for receiving the article 18, by virtue of a downward movement of the gripper 26. The vertical component of motion of each gripper 26 which provides for fitting the article to be printed upon into the receiving means 32 or for lifting the printed article 18 out of the receiving means 32 permits the holder 16 to be of a design configuration such that the receiving means 32 does not need to perform any vertical movement.

The procedure for introducing the article 18 into the holder 16 must be concluded when, in the course of its transportation movement in the direction indicated by the arrow 12, the holder 16 reaches the second transitional portion 66 between the upper cam 62 and the main cam portion indicated at 46. In that second transitional portion 66 corresponding downward movement of the cam roller 42 causes the second holder portion 34 to be moved downwardly into its operative position in which the cam roller 42 is again at the level of the main cam portion 46 and then in the further course of the transportation movement is guided therein until it again passes into the region of the first transitional portion 64.

With the stationary arrangement of the two transitional portions 64 and 66 in the position shown in FIG. 1, each holder 16, in each circulatory cycle, would first be opened in the first transitional portion 64 and then would remain opened until it passes the second transitional portion 62. Such an arrangement however is not possible if the articles 18 cover more than one circulation in the printing machine 10 before they are removed from the respective holder 16 in which they are carried. In order to permit treatment of the articles 18 in a manner such that they circulate through the printing machine 10 more than once, the illustrated embodiment of the invention is provided along the upper cam portion 62 with a second cam portion 44 which is disposed therebeneath and which is also arranged stationarily. In addition, provided beneath the respective transitional portions 64 and 66 is a respective linear transitional portion 68 and 70 as clearly shown in FIG. 1. A respective inclined transitional portion 64 or 66 and a respective associated linear transitional portion 68, 70 are disposed on a respective common carrier 72 and 74 respectively, which thus performs the function of a points assembly or path-switching assembly. In particular FIG. 1 clearly shows that suitable vertical displacement of the two carriers 72 and 74 makes it possible to set a cam configuration which corresponds to the respective requirements involved.

As, in the illustrated embodiment, a common drying station is arranged downstream of each two printing stations, then, as already mentioned above, when the printing procedure involves applying six partial print images to each article 18, the article would pass through the path of transportation movement through the printing machine 10 almost twice, and an article which is introduced into the printing machine 10 by the transfer device 22 would firstly be printed upon in the printing station I, whereupon the print image applied thereto is dried in the drying station A before the second print image is applied to the same article in the printing station IV. That second print image is then dried in the drying station B, whereupon then the article is provided with the third print image in the printing station V which follows the drying station B, the third print image being dried in the drying station C. The latter is disposed upstream of the removal station at which the second transfer device 30 is operatively arranged.

As the article 18 which at that time has been provided with three print images is still to be provided in the stations II, III and VI with a total of three further print images, the article is not removed from the printing machine 10 after that first passage therethrough. On the contrary, the two carriers 72 and 74 are displaced upwardly into the position shown in FIG. 1 in which the horizontal connecting portions 68, 70 make a connection between the lower cam portion 44 and the main cam portion 46. As the cam portion 44 extends at the same level as the main cam portion 46, the cam roller 42 carried by the upper holder portion 34 does not experience any change in its heightwise position so that the holder portion 34 remains in engagement with the article 18' for the second passage thereof through the printing machine 10, as is clearly shown in FIG. 6. At the end of the second passage through the machine, when the article reaches the removal station, the two carriers 72 and 74 are displaced into the position shown in FIG. 1, with the result that the cam roller 42 of the next holder 16 which reaches the carrier 72 is displaced upwardly and in so doing moves the second holder portion 34 out of engagement with the article 18 so that the latter can be removed in the manner already described above from the printing machine 10 by the operation of a gripper 26 of the second transfer device 30.

In the above-described procedure which involves the implementation of six printing operations on each article 18, each second article which reaches the removal station formed by the transfer device 30 is removed from its holder 16. Accordingly, it is also only each second holder which arrives at the feed station formed by the transfer device 22 that is empty, and is to be correspondingly provided with a fresh article 18 to be printed upon. This means that the carriers 72 and 74 are to be displaced after each passage of an article 18. The result of this is that, in the portion of the path of transportation movement between the two carriers 72 and 74, the cam rollers 42 of the holders 16 passing through that region are guided alternately in the lower cam portion 44 and in the upper cam portion 62 as, of two directly successive holders 16, the one is opened and the other is closed.

In the specific embodiment illustrated herein, each of the two carriers 72 and 74 is provided with an extension portion as indicated at 76 in FIG. 1, on which a cam roller indicated at 78 is mounted. The cam roller 78 co-operates with a peripherally extending cam 80. The two cams 80 are rotated by way of a common toothed belt 82. The moment of displacement of the respective carrier 72 and 74 is determined by the configuration of the respective cam 80 at a given speed of rotation thereof. It will be appreciated that it is also possible to provide a separate drive for each carrier, as a departure from the structure illustrated in the drawing in FIG. 1. In that case the two carriers 72, 74 can be actuated independently of each other, for example under time control.

Looking now more particularly at FIG. 5, shown therein is the configuration of the second cam 60 in which the cam rollers 58 of the toothed segments 52 of which one is shown by way of example in FIG. 5 of all the holders 60 are guided. More specifically, the configuration of the cam 60 is so selected that in each printing station I through VI the cam 60, as considered in the direction of transportation movement 12, has a rising portion 84*a* which begins just before the location at which the article 18 comes into contact with a screen printing stencil at the printing station I, and terminates just after the location at which the printing operation is concluded. That rising cam portion 84*a* is then followed by a falling cam portion 85*a* which extends as far as the beginning of the next cam portion 84*b* which is once again a rising cam portion. In this case references to a 'rising' cam portion mean that the cam 60 experiences an increase in diameter in the transportation movement direction 12 while references to a 'falling' cam portion correspondingly indicate that the cam 60 experiences a reduction in diameter in such a portion, in the transportation movement direction 12. In each rising cam portion, there is transmitted to the toothed segment 52 a pivotal movement which by way of the gear 50 results in rotary movement of the article 18 held by the lower holding portion 32, through an angle of up to 360° or under some circumstances possibly even more. The rising portion of the cam is associated in each case with a respective printing station so that the rotary movement of the article 18 takes place in a first direction in which the peripheral surface of the article 18 is rolled against a screen printing stencil in the respective printing station.

Reference will again be made at this juncture to FIG. 2A which, in connection with the printing station I, shows the position of the respective toothed segment 52 whose holder, which is not shown in FIG. 2*a,* in the course of the transportation movement in the direction indicated by the arrow 12, has just passed into the region, which leads in the transportation direction, of the rising portion 84*a* of the cam 60, which is associated with the printing station I, whereby the first rotary movement in the clockwise direction of the associated holder with the article 18 carried thereby about the longitudinal axis thereof has begun. At that time, the screen printing stencil as is diagrammatically indicated at 89 in FIG. 2A is disposed in operative contact with the article 18 to which printing is to be applied, for example for decorative purposes. That is generally achieved by suitable positioning of the squeegee or doctor indicated at 90, by which the screen printing stencil 89 is pressed against the surface of the article, to which printing is to be applied. In the further course of the printing procedure, the article 18 is rolled against the stencil 89, with the squeegee or doctor executing a corresponding synchronous displacement into the limit position as indicated at 90', in which the printing procedure is concluded. FIG. 2B shows that, with the components in that position, the toothed segment 52 has virtually concluded its rotational movement, being therefore now in a position indicated at 52'. This also corresponds to the position as indicated at 58' of the cam roller 50, which is near the transition indicated at 86 in FIG. 5 from the rising portion 84*a* to the falling portion 85*a* of the cam 60. In this situation, the vertical axis of rotation of the toothed segment 52 which in contrast to the cam roller 58 moves on a circular path assumes the position indicated at 54'.

When the squeegee or doctor 90 is approximately at the position indicated at 90' in FIGS. 2A and 2B, the stencil 89 which during the printing operation with the squeegee or doctor 90 has performed a slight pivotal movement about the vertical axis 91 is brought out of contact with the article by virtue of the doctor or squeegee 90 being withdrawn from the article somewhat, with the consequence that the stencil comes out of operative contact with the article by virtue of the elasticity of the stencil.

The above-mentioned elasticity of the printing stencil can result in a certain degree of distortion and thus deformation of the stencil. As however all movements which take place during the printing procedure occur in only one respective direction, insofar as the articles rotate during the printing operation in the clockwise direction about their longitudinal axis which means that the direction of movement of the doctor or squeegee 90 is necessarily in the direction 12 of transportation movement, the distortion of the stencil also occurs in the same direction in all printing stations so that the position of the partial print images applied to an article in each of the respective individual printing stations is not visually altered relative to each other.

Referring again to FIG. 5, when the cam roller passes the following falling cam portion 85*a,* the toothed segment 52, after having come to a stop in the transitional region 86, is pivoted back into its initial position again through the same angle of at least 360°, with the consequence that the corresponding article 18 is also again rotated back into its initial position. After reaching the position 90' shown in FIGS. 2A and 2B, the doctor or squeegee 90 is moved back into its initial position again. That also applies in regard to the stencil 89 if this had been displaced during the printing operation.

The above-described movements of the holders 16 and therewith the articles 18 carried thereby take place in conjunction with the passage through each printing station and directly following the respective printing procedure so that, when the cam portion indicated at 84*b* in FIG. 5 which is associated with the printing station II and which is again a rising cam portion is reached, the article again implements a rotary movement in the first direction. That is then again followed by a falling cam portion 85*b*. When the cam roller travels along the cam portion 85*b,* the article 18 is again rotated back into its initial position in the counter-clockwise direction. The screen printing stencil at the printing station II however remains out of contact with the article which had been previously printed upon in the printing station I, and merely passes through the station II on its way to the drying station A which is disposed downstream of the printing station II in the direction of transportation movement 12. The drying operation can already begin when the cam roller is moving along the falling portion 85*b* of the cam 60 and can extend as far as the beginning of the following rising cam portion 84*c* which is associated with the printing station III.

Drying of the print image applied to the respective article 18 in the printing station I takes place in the drying station A. After the drying operation, the article 18 passes through the next printing station III without any printing operation taking place there. In this case also therefore the stencil in the screen printing station III remains out of contact with the respective article 18. While it is passing through the printing station III, the article also performs a rotary movement in the first direction, corresponding to the rising cam portion 84*c,* and thereafter, corresponding to the subsequent falling cam portion 85*c,* the article is again rotated back into its initial position which the article assumes when the cam roller 58 is in the inner transitional region 86 of the cam 60 between the falling cam portion 85*c* and the subsequent rising cam portion 84*d* which is associated with the printing station IV. After the article had previously been subjected to a first drying operation in the drying station A, the printing station IV involves application of a second print image to the article, in which case the article is rotated about its longitudinal axis in the first direction in the manner already described above, while the cam roller is passing through the cam portion 84*d*. While it is passing through the subsequent cam portion 85*c,* the article passes into the region of the drying station B in which the printing ink applied to the article in the printing station IV is dried. As the article 18 must be rotated back into its initial position again for the printing operation which possibly takes place in the printing station V, from its angular position which it adopted after the conclusion of the printing operation in the printing station IV, the overall peripheral surface of the article is subjected to the action of drying radiation in the drying station B, at least over an extent corresponding to the extent thereof which is covered by a print image, thereby ensuring adequate drying of the print image.

A corresponding procedure also applies in regard to the other drying stations A and C. It will be noted that the configuration of the cam 60 is so selected that the article rotates at a constant speed about its longitudinal axis during the printing step and the irradiation step for drying the printing on the article.

After the article has passed through the drying station B, the cam roller 58 on the toothed segment 52 passes into the rising cam portion 84*e* associated with the next following printing station V, with the consequence that the article to be printed upon is rotated in the first direction, which can be referred to as the printing direction. When that occurs, the third print image is applied to the respective article in the printing station V in the first passage of that article through the apparatus.

Accordingly, here the stencil of the printing station V is brought into contact with the article. When the article passes through the following falling cam portion 85*e,* the article is once again rotated back into the initial position about its longitudinal axis. The article which had been printed upon in the station V passes through the station VI without coming into contact with the printing stencil thereof. Also associated with the printing station VI is a rising cam portion 84*f* followed by a falling cam portion 85*f*. When the article passes through the latter, it comes into the region of the drying station C in which the ink applied to the article in the printing station V is dried.

Looking still at FIG. 5, the region of the cam 60 which is downstream of the drying station C in the direction of transportation movement 12 extends substantially coaxially with respect to the axis of rotation as indicated at 88 of the transport device or disk 14, as, in the region of the transfer stations 30 and 32, the articles do not perform any rotary movement about their longitudinal axis in order in that way to simplify the transfer operation.

In the course of its passage as described hitherto through the printing stations I through VI, the article had been printed upon only in three printing stations, more specifically printing stations I, IV and V. If the article is now also to be printed upon in the other printing stations II, III and VI, it is necessary for that article to be passed through the machine once again. That presupposes that the holder 16 carrying the respective article remains closed while passing through the removal station at 30 and the feed station at 22, in other words, the upper holder portion 34 is to remain in its downwardly displaced position which is shown for example in FIG. 3. It is therefore necessary for the carrier 72 to be set in a position such that the connecting portion 68 which extends in a horizontal plane forms a connection between the main cam portion 46 and the lower cam portion 44 in the region of the feed and the removal stations, so that the cam roller 42 retains its lower position and the holder 16 remains closed and passes in that condition through the removal and feed stations, and then after passing the suitably set second carrier 74, continues into its second passage through the apparatus.

As the article 18 such as a bottle which is disposed in the respective holder 16 had already been printed upon in the station I in its first passage through the apparatus, that article, on passing through the station I, remains out of contact with the screen printing stencil thereof. However, it performs the rotary movement already described with reference to the first passage of the article through the apparatus, by virtue of the cam roller 58 being guided in the cam 60. That also applies when the article passes through the printing station II but it is here that the article receives a fourth print image thereon by an appropriate printing procedure. Subsequently the article in turn passes through the drying station A for drying the print image thereon. In the course of further movement in the direction of transportation movement 12 the article is provided with a respective further print image in the station III and then, after drying in the drying station B, in the printing station VI. The print image applied to the article in the printing station VI is dried in the drying station C before the article which has now had all the printing applied thereto, with for example six different colors or inks thereon, is removed from the printing machine at the removal station formed by the transfer device 30.

As the holder 16 of that article 18 has to be opened to permit the article 18 to be removed from the holder 16, it is necessary for the first carrier 72 to be set in such a position, immediately before the holder 16 passes into the removal station, that the first transitional portion 64 which extends inclinedly relative to the horizontal passes into its operative position in which it forms a connection between the main cam portion 46 and the also stationary upper cam portion 62 so that the holder 16 is opened on passing through the first transitional portion 64. As the holder does not perform any rotary movement in that region, it is readily possible for the article 18 to be removed from the opened holder in the removal station, and then, when that holder passes through the subsequent feed station formed by the transfer device 22, an article to which printing is to be applied can be introduced into that holder which is now in the empty condition. When the second carrier 74 is reached, it must be set in such a position, as shown in FIG. 1, that once again a connection is made between the upper cam portion 62 and the main cam portion 46 which follows same in the direction 12. On passing through the second transitional portion 66, the respective holder 16 is closed so that the gripper of the transfer device which had held the article until then can be opened.

The article then passes through the printing machine in the above-described manner, in which case it covers overall a distance of nearly 720° before it is removed from the machine. In that respect it is necessary for the carriers 72 and 74 to be displaced and adjusted after each holder 16 has passed through those locations, as the articles respectively arriving at the removal station are alternately those which are in a finished, fully printed condition and which are to be removed from the machine, and those, as indicated at 18' in FIG. 6, which need a second passage through the printing machine for the purposes of applying the second series of print images.

As a departure from the above-described mode of operation it is also possible in those cases in which the articles are only to be provided with three partial print images, that is to say for example for producing a three-color print image, for the articles to be removed from the machine after only one passage therethrough. In that case, one group of articles is subjected to the printing procedures in the printing stations I, IV and V while the other group of articles, involving the same number of articles as the first-mentioned group, are subjected to printing operations in the other printing stations II, III and VI. In this case, the articles of both the groups can be provided with the same print images. It will be appreciated however that it is alternatively also possible for the two groups of articles to be provided with different print images.

It will be appreciated that at any event the above-described apparatus structure and the mode of operation that it entails ensures that the articles are accurately oriented and aligned in the peripheral direction thereof as, after the respective holder 16 has been definitively closed, the article 18 remains in its position relative to the holder 16 carrying it and changes in the position of the article 18, in particular also its angular position in the peripheral direction, occur necessarily in dependence on the configuration of the second cam 60 and are possible only in dependence on that configuration.

It has already been mentioned above that, when implementing a triple printing procedure, for example with three different printing inks for producing three print images on an article, utilising all the printing stations in the apparatus, the through-put capacity of the machine in relation to the number of articles per unit of time is twice as great as when implementing sextuple printing involving applying six print images to an article. Accordingly, twice as many articles have to be fed into the printing machine at the feed station formed by the transfer device 22, and twice as many articles also have to be removed from the machine at the removal station. As therefore double the number of articles have to be handled per unit of time, the two transfer devices 22 and 30 have to be suitably adapted with the same speed of rotation of the transfer devices and the disk 14. In the case of the illustrated embodiment, as can be clearly seen from FIGS. 2A and 2B, the transfer devices 22 and 30 are of such a structure that the respective carrier plate 24 thereof can be provided in the proximity of its periphery with six grippers which are indicated by reference numeral 26 in for example FIG. 6. That number of grippers is required when the second of the above-described operational options is used, namely in which the articles are each removed from the printing machine after one passage through the apparatus, with a three-color print image on the article. In the other operational option, with six-color printing and correspondingly half the throughput rate, each carrier plate 24 of the transfer devices 22 and 30 could be provided only with three grippers 26, with the speed of rotation of the carrier plates 24 being the same in both cases.

When the articles perform only one passage through the printing machine, the two carriers 72 and 74 shown in FIG. 1 are permanently set in such a way that the cam roller 42 which respectively controls the movement of the upper holder portion 34 always passes through the upper cam portion 62 disposed between the two carriers 72 and 74 as each holder has to be opened before arriving at the removal station and closed after the feed station.

Reference will again be made to FIGS. 2A and 2B showing that the toothed segments 52 operatively associated with the individual holders 16 are so dimensioned that the paths of movement of the toothed segments 52 of two immediately adjacent holders 16 overlap each other. It may be necessary for that reason for the toothed segments 52 of immediately adjacent holders 16 to be arranged in mutually displaced relationship in respect of height in order in that way to ensure that the mobility of the toothed segments is not restricted by the presence of the adjacent toothed segments.

It will be noted here that the gear 50 for transmission of the movement to the respective toothed segment 52 can be of the same diameter, irrespective of the diameter of the surface of the respective article 18, to which printing is to be applied, so that there is therefore no need to replace the gears 50 of the holders 16 when the procedure carried out in the printing machine involves dealing with articles of a different diameter, for example when changing from one batch of articles to be printed upon, to a different batch. Changes in the diameters of the articles can be compensated, with the diameters of the gears 50 remaining unchanged, by virtue of the fact that, during the printing operation, the screen printing stencil can be displaced with a compensatory effect either in the direction of movement of the article in the transportation direction 12 or in the opposite direction thereto, in which respect such movement of the stencil can occur substantially tangentially with respect to the circular transport path defined by the disk 14.

The fact that the article also moves along an arcuate path during the printing operation means that it may be necessary to adapt the position of the screen printing stencil 89 at a printing station to the position of the article during the printing procedure. Thus, the angular position of the screen printing stencil which extends substantially in a vertical plane can be adapted to the position of the article to be printed upon, in any suitable manner, for example as described in U.S. Pat. No 4,798,135. The disclosure thereof is hereby incorporated into the disclosure of the present application by virtue of reference thereto. Another option in that respect is for the screen printing stencil to be displaced during the printing operation relative to the center of the point of rotation of the machine, in order in that way to compensate for the varying spacing of the peripheral surface of the article 18 to which the printing is to be applied, relative to the screen printing stencil which is disposed in tangential relationship with the transport path defined by the disk 14. It will be noted however that there is also the possibility of using a screen printing stencil of a somewhat curved configuration, in which case the screen printing stencil is arranged approximately coaxially with respect to the transport path along which the articles 18 are moved. There is moreover also the above-mentioned possible option of bringing the screen printing stencil into and out of contact with the respective article 18 to be printed upon, by means of a certain degree of elastic deformation of the screen printing stencil by virtue of suitable positioning of the associated doctor or squeegee, thereby to influence and control the printing operation and the relative position of the doctor or squeegee with respect to the article.

As already indicated above, the two transfer devices 22 and 30 at the feed station and the removal station respectively are provided with a plurality of gripper systems which are so designed that, when the article is introduced into and removed from the printing machine, the situation involves coincidence of the positions of the gripper on the one hand and the holder on the continuously circulating annular disk 14 on the other hand. That can be achieved by each gripper performing additional movements relative to the carrier plate 24 thereof, in order on the one hand to have time for the respective article 18 to be positioned vertically in the respective holder 16 or lifted out of same by a vertical movement. However, as already indicated above, it is also possible to use other forms of transfer devices for fitting the articles 18 to the holders 16 and removing them therefrom.

When reference is made hereinbefore to an embodiment having twenty seven receiving means for receiving articles 18, six printing stations and three drying stations, those figures are not intended to denote a limitation in terms of the structure and mode of operation of the invention. On the contrary, it is readily possible for the printing machine to be provided with different numbers of printing stations and drying stations, for example four printing stations and two drying stations, which are then to be arranged in the appropriate manner, that is to say with a respective drying station downstream of two printing stations in the direction of transportation movement. The odd number of receiving means for receiving the articles 18 can then be for example twenty one.

It will be appreciated that the above-described apparatus and the mode of operation thereof have been set forth solely by way of example and illustration of the principles of the present invention and that various modifications and alterations may be made therein without thereby departing from the spirit and scope of the invention.

What is claimed is:

1. Apparatus for printing on dimensionally stable individual articles, comprising:

a transport means, a plurality of holders for respective articles on the transport means, means for continuously circulating the transport means for transporting the articles carried by a respective holder along a transport path through the apparatus, at least one treatment station operatively associated with the transport path including at least one printing station, at least first and second transfer stations operatively associated with the transport path, one said transfer station being a feed station operable to fit articles to be printed upon to said holders on said transport means and the other transfer station being a removal station operable for removal of printed articles from said holders of the transport means, and means operable during a printing operation to rotate an article about a longitudinal axis thereof in a first direction determined by the printing procedure and the transport direction and after termination of the printing procedure to rotate the article back into its initial position by rotation thereof about said longitudinal axis in a second opposite direction.

2. Apparatus as set forth in claim 1 wherein said means for rotating said articles about their respective axis are inoperable for rotating said articles in said transfer stations.

3. Apparatus as set forth in claim 1 wherein each article in its holder assumes a position in which said axis of the article extends substantially vertically.

4. Apparatus as set forth in claim 1 wherein said holders each comprise first and second portions, the first holder portion being a receiving means for accommodating a lower end portion of a said article and said second holder portion being operable to hold a said article at the upper end portion thereof, and means for reciprocating said second holder portion between a first position in which it is in engagement with a said article to hold same in position in said holder and a second position in which said second holder portion is disengaged from said article.

5. Apparatus as set forth in claim 4 and further comprising:

a gear connected to the lower receiving means of said first holder portion in coaxial relationship with respect to its longitudinal axis and a rotatably supported element having a tooth means engaged with said gear, a cam roller on said element at a spacing from its axis of rotation, and a cam on the machine frame and co-operable with the cam roller, the configuration of said cam determining the rotary movement of the lower receiving portion.

6. Apparatus as set forth in claim 5 wherein said cam is an endless cam.

7. Apparatus as set forth in claim 5 wherein said cam extends substantially parallel to the transport path at least in the region of said transfer stations.

8. Apparatus as set forth in claim 5 wherein at least one treatment station is a screen printing station and wherein the diameter of the gear is independent of the diameter of a said article to be printed upon and relative adaptation of the peripheral speed of the surface of the article to the transport speed is effected by setting the speed at which a screen printing stencil for applying printing to said article is moved.

9. Apparatus as set forth in claim 4 including in each transfer station a transport element, means operable to rotate the transport element continuously in a horizontal plane, and grippers carried by said transport element for transposing a said article with respect to a holder.

10. Apparatus as set forth in claim 9 including means for mounting said grippers to the respective transport element movably upwardly and downwardly, the arrangement being such that an article to be printed upon is fitted into the receiving means of its holder by means of a downward movement of the respective gripper and a printed article is removed from said receiving means by an upward movement of the respective gripper.

11. Apparatus as set forth in claim 9 comprising first and second drying stations, wherein the article performs as many passes through the transport path as there are printing stations between the first and second drying stations, and in each pass the article is printed upon in another of said printing stations.

12. Apparatus as set forth in claim 9 comprising a total of six printing stations disposed along the transport path, wherein the arrangement is such that for carrying out six printing operations executed in succession on the same article the article is moved a total of twice past the printing stations and is printed upon in each case only in one of two printing stations arranged upstream of a common drying station.

13. Apparatus as set forth in claim 4 including a machine frame structure, a cam on the machine frame structure, wherein the upper holder portion includes an extension portion engageable with the cam on the machine frame structure, the position of the holder portion during transport along the transport path being dependent on the configuration of the cam.

14. Apparatus as set forth in claim 1 wherein said transport means includes an odd number of holders for said objects, and further including a plurality of sets of printing stations each including at least first and second printing stations, and a respective drying station downstream of each of set of printing stations in the transport direction, wherein in each passage of the articles through the transport path printing is effected only in one of the printing stations of each set of printing stations, and wherein successive printing stations in which an article is printed upon are at a spacing from each other which is an even multiple of the spacing of two adjacent holders in the transport direction and the spacing between the at least first and second printing stations of each set is an odd multiple of the spacing of two adjacent holders.

15. Apparatus as set forth in claim 14 wherein each article is printed upon only in one of the printing stations disposed upstream of a common drying station and is removed from the apparatus after a pass through the transport path.

16. Apparatus as set forth in claim 15 including in the region of the transfer stations first and second cam portions for positioning of the upper holder portion, one said cam portions producing a closed position of the upper holder portion and the other cam portion producing an open position of the upper holder portion, the arrangement being such that the first and second cam portions are alternately operative and inoperative in dependence on whether a printed object approaching the removal station in the transport path is removed in the removal station by the transfer means thereof and is removed only after at least one further passage along the transport path.

17. Apparatus as set forth in claim 1 wherein the treatment station is a screen printing station.

18. Apparatus for printing on dimensionally stable individual articles, including a transport means, a plurality of holders for respective articles on the transport means, means for continuously circulating the transport means for transporting the articles carried by a respective holder along a transport path through the apparatus, wherein said transport means includes an odd number of holders for said objects, and further including a plurality of sets of printing stations each including at least first and second printing stations, and a respective drying station downstream of said printing stations in the transport direction, wherein in each passage of the articles through the transport path printing is effected only in one of the printing stations of each set of printing stations, and wherein successive printing stations in which an article is printed upon are at a spacing from each other which is an even multiple of the spacing of two adjacent holders in the transport direction and the spacing between the at least first and second printing stations of each set is an odd multiple of the spacing of two adjacent holders.

19. Apparatus for printing on dimensionally stable individual articles, comprising:

a transport means;

a plurality of holders for respective articles on the transport means;

means for continuously circulating the transport means for transporting the articles carried by a respective holder along a transport path through the apparatus, the transport means including an odd number of holders for the articles;

a plurality of sets of printing stations each including at least first and second printing stations;

means operable during a printing operation for rotating the articles being transported about a longitudinal axis of the articles; and a respective drying station downstream of the printing stations in the transport direction, wherein in each passage of the articles through the transport path printing is effected only in one of the printing stations of each set of printing stations, and wherein successive printing stations in which an article is printed upon are at a spacing from each other which is an even multiple of the spacing of two adjacent holders in the transport direction and the spacing between the at least first and second printing stations of each set is an odd multiple of the spacing of two adjacent holders.

* * * * *